United States Patent [19]

McWain

[11] Patent Number: 5,072,935

[45] Date of Patent: Dec. 17, 1991

[54] COLLAPSIBLE THERAPEUTIC WEIGHT SYSTEM

[76] Inventor: Richard J. McWain, Orange, Calif.

[21] Appl. No.: 286,222

[22] Filed: Dec. 19, 1988

[51] Int. Cl.[5] ..... A63B 21/065

[52] U.S. Cl. ..... 272/119; 383/120

[58] Field of Search ..... 272/67, 68, 71, 116, 272/117, 119, 122, 123, 130, 143; 215/1 A, 1 L; 220/DIG. 13; 222/92, 95, 215; 383/120, 907

[56] References Cited

U.S. PATENT DOCUMENTS

| | | | |
|---|---|---|---|
| 325,987 | 9/1885 | Sparks . | |
| 687,790 | 12/1901 | Scales | 222/92 |
| 2,780,378 | 9/1957 | Romano . | |
| 3,231,270 | 1/1966 | Winer . | |
| 3,939,887 | 2/1976 | Scarnato | 383/120 X |
| 3,946,903 | 3/1976 | Parker | 222/92 |
| 4,029,312 | 6/1977 | Wright | 272/123 |
| 4,191,302 | 3/1980 | Fiducia | 215/1 A X |
| 4,199,140 | 4/1980 | Feretti | 272/123 |
| 4,222,560 | 9/1980 | Hallerman | 272/68 |
| 4,344,620 | 8/1982 | Debski | 272/119 |
| 4,492,313 | 1/1985 | Touzani . | |
| 4,530,496 | 7/1985 | Smith et al. | 272/68 |
| 4,671,507 | 6/1987 | Huttner | 272/119 X |
| 4,695,051 | 9/1987 | Jenison | 272/122 |
| 4,798,313 | 1/1989 | Farley | 222/215 X |

FOREIGN PATENT DOCUMENTS

| | | | |
|---|---|---|---|
| 28047 | 12/1912 | United Kingdom | 272/122 |

*Primary Examiner*—R. Bahr

*Attorney, Agent, or Firm*—Walter A. Hackler

[57] ABSTRACT

A collapsible therapeutic weight system is provided which includes a diaphragm having a accordion-like wall for enabling the diaphragm to be expanded and contracted to accommodate various amounts of a liquid and fully collapsible when not containing a liquid. A sealable opening in the diaphragm is provided for enabling the filling and emptying of the diaphragm and the diaphragm is shaped for enabling the diaphragm to be disposed in a position encircling a patient's limb.

9 Claims, 1 Drawing Sheet

COLLAPSIBLE THERAPEUTIC WEIGHT SYSTEM

The present invention generally relates to therapeutic treatment and, more particularly, relates to a therapeutic weight system for the toning of muscles and the prevention of atrophy subsequent to trauma or post-operative recovery.

While a great number of weight-lifting systems and many configurations of weights are in popular use today and many gymnasiums and exercise/health club facilities offer exotic arrays of exercise equipment specifically designed for the toning of certain muscles in the body, none of these are suitable for a convalescing patient, who often is unable to autonomously arise from a bed or move about in a normal manner.

It is well known that exercise under the direction of a physical therapist promotes the recovery of a patient's damaged muscle tissue or prevention of muscle atrophy during the recovery from a stroke, or the like.

It should easily be appreciated that weight equipment useful in such physical therapy can easily be distinguished over conventional exercise equipment, for it most often requires structure specifically designed to function for convalescents who are unable to handle conventional exercise equipment. For example, in many instances, a patient may not have the physical capability to grasp a weight in order to exercise the muscles.

In addition, it should be easily recognized that weights for physical therapy are generally much lighter than those used in conventional exercising. It is also important to note that the weight range, or gradation of increasing sizes of weights, is far more defined to meet the needs of a patient in need of therapeutic rehabilitation. That is, the weights must be provided in increasing weight increments suitable for this specific capability of individual patients. The present invention meets that need.

SUMMARY OF THE INVENTION

A collapsible therapeutic weight system, in accordance with the present invention, generally includes diaphragm means for containing a liquid, with the diaphragm means including accordion-like wall means for enabling the diaphragm means to be collapsed when not containing a liquid. The accordion-like wall means, or foldable wall means, enable the diaphragm means to expand and contract for accommodating various quantities of liquid. This is an important feature of the present invention since the weight of the collapsible therapeutic weight system therefore can be varied in a continuous manner by the addition of subtraction of liquid contained therein in order to match the weight thereof to the requirements set down by a physical therapist according to a patient's needs.

To facilitate the addition and removal of liquid means defining a sealable opening in the diaphragm means is provided. In addition, means defining an exterior shape of the diaphragm means for enabling the diaphragm means to be disposed in a position encircling a patient's limb is provided. This feature importantly enables the diaphragm means to be attached, or applied to a patient's limb without the necessity of a patient grasping of the diaphragm means itself.

More particularly, the means defining an exterior shape of the diaphragm means may define a helix, in which the diaphragm means may be wrapped around a patient's limb. Alternatively, the means defining an exterior shape of the diaphragm means may define a toroid, in which case the patient's limb, arm or leg may be inserted through the toroid. In the case where the diaphragm means is the shape of a toroid, it is configured to be collapsible along the longitudinal axis thereof.

In instances where the diaphragm means is to be used for a patient who is totally bedridden, the means defining the exterior shape of the diaphragm means may so define that shape to enable the diaphragm means to partially encircle a patient's limb. In this instance, means are provided for securing the diaphragm means of the patient's limb. The latter embodiment may be useful in instances where a diaphragm means totally encircling a patient's limb may provide discomfort to the patient.

BRIEF DESCRIPTION OF THE DRAWINGS

The advantages and features of the present invention will appear from the following description when considered in conjunction with the accompanying drawings in which.

DETAILED DESCRIPTION

Figure 1:
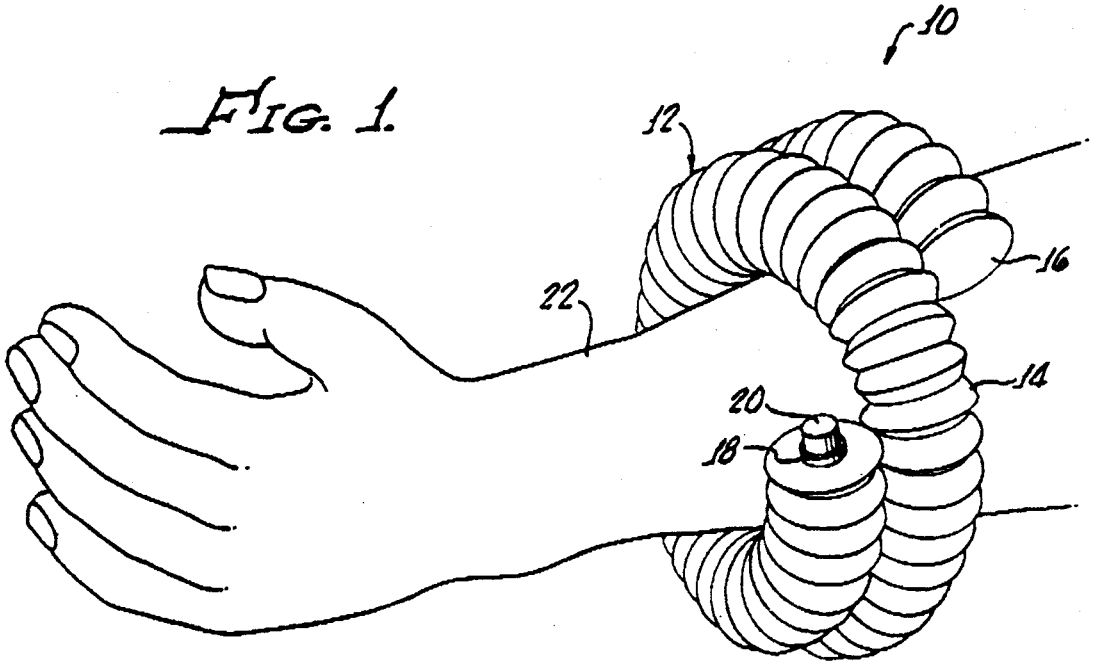
FIG. 1 is one embodiment of the present invention showing diaphragm means in the shape of a helix enabling the collapsible therapeutic weight system to be wrapped around a patient's arm.

Turning now to FIG. 1 there is shown a collapsible therapeutic weight system 10 in accordance with the present invention, generally including diaphragm means 12 for containing a liquid with the diaphragm means 12 including an accordion-like wall 14 which provides means for enabling the diaphragm means 12 to be collapsed when not containing the liquid. It also should be appreciated that the accordion-like wall enables the diaphragm to expand or contract as needed for holding various volumes of liquid. This is important in that the precise weight of the filled diaphragm can be adjusted to accommodate patient's needs as may be prescribed by a physical therapist.

This feature enables the single diaphragm 12 to provide an almost infinite number of discreet weights by varying the liquid content therein, rather than a weight system (not shown) which includes a plurality of solid or fixed weights which can be used singly or in combination to provide a variation in the overall weight of the system.

It should be appreciated that any number of pleats or folded-type collapsible wall systems as may be known in the art may be suitable for the present invention. It is also preferred that the material of construction be a non-toxic plastic material so as to eliminate any abrasion of the patient's skin due to an allergic reaction. It is also preferred that the diaphragm be molded in order to eliminate the possibility of burrs or the like which may cause irritation to the patient and the diaphragm be molded in a single piece to simplify fabrication thereof. One end of 16 of the helix-shaped diaphragm may be sealed and the other may include an opening 18 which provides means for filling and emptying the diaphragm with liquid. A screw-on cap 20 or the like may be conveniently used for sealing the diaphragm opening after filling with water. The shape of the diaphragm 12 is defined in a manner enabling the deposition of the diaphragm means on to a patient's limb, for example, an arm 22, shown in FIG. 1. Because of the flexibility of the diaphragm as caused by the pleated wall 14 therein, it may be unwound from its natural helical shape to facilitate the insertion of an arm therethrough. Alternatively, the arm may be inserted through the diaphragm 12.

Figure 2:
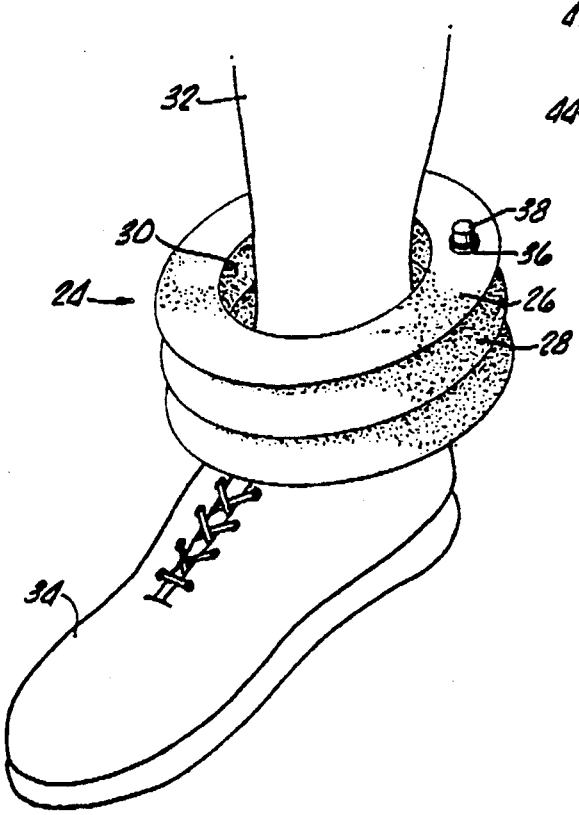
FIG. 2 is a perspective view of another embodiment of the present invention showing diaphragm means in the shape of a toroid and thus enabling the therapeutic weight system to be disposed around a patient's leg.

As shown in FIG. 2, in accordance with the present invention, a collapsible therapeutic weight system 24 may include diaphragm means 26 having accordion-like walls 28 which define the diaphragm means 26 in the shape of a toroid. In this instance, the diaphragm means 26 is collapsible along a longitudinal access thereof. As shown in FIG. 2, the diaphragm means 26 includes a central opening 30 of the toroid which is sized for disposing around a patient's limb, for example, a leg 32, the opening 30 to be sized so as to enable a patient's foot 34 to be inserted therethrough. An opening 36 and cap 38 are provided in the accordion-like walls 28 to accommodate filling and emptying of the diaphragm means 26. As in the case of diaphragm means 14, the materials of construction are preferably a non-toxic plastic and more preferably formed or molded from a single piece thereof.

It should be appreciated that the embodiments of the present invention shown in FIG. 2 are suitable for use by a patient having the ability to suspend his or her arm or leg so as to avoid contact of the collapsible therapeutic weight 10 with other nearby objects. For example, it is intended that the use of the weight system may be advantageous when positioned on the patient's leg when the patient is in a sitting position on a bed with his or her legs dangling therefrom. Movement in an upward and downward fashion with the diaphragm means 26 in place as prescribed by a physical therapist may have beneficial results. The embodiment 10 may be used in a similar fashion.

Figure 3:
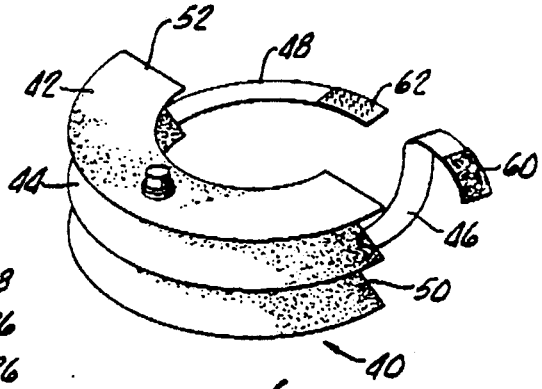
FIG. 3 is yet another embodiment of the present invention showing the diaphragm means in the shape of a semi-toroid along with a strap attached thereto for enabling the therapeutic weight system to be applied to a patient's limb.

In instances where a patient's limb is to be exercised from a position in contact with a bed to a position disposed above the bed, the surrounding diaphragm 14 or 26 may provide some discomfort to the patient. In that regard, in accordance with the present invention, a collapsible therapeutic weight system embodiment 40 is shown in FIG. 3 which includes a diaphragm 42 having pleated walls 44 and similar in construction to the embodiment 24 shown in FIG. 2, except it is formed into a semi-toroid. In this instance, straps 46, 48 may be attached to ends 50, 52 of the diaphragm 42 in a conventional manner and provided with Velcro-type ends 60, 62 for disposing the weight system 40 on to a patient's limb, as for instance, passing the straps 46, 48 beneath a person's leg and allowing the diaphragm 42 to rest on top of the patient's leg while he is in a prone position on the bed.

Figure 4:
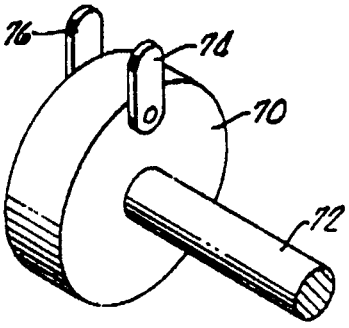
FIG. 4 is a hub for optional attachment to the toroid shown in FIG. 2 for enabling the toroid-shaped diaphragm to be used in a conventional weight lifting manner.

In order to provide greater versatility for the collapsible therapeutic weight system 24 shown in FIG. 2, a hub 70, as shown in FIG. 4, may be provided which is sized for insertion into the center 30 of the toroid-shaped diaphragm 26, in order to provide means for mounting the toroid-shaped diaphragm-shaped diaphragm 26 onto a bar 72, the latter having a substantially smaller diameter than the opening 30 in the toroid and sized for grasping by a patient in advance stages of therapeutic rehabilitation. A pair of lugs 74, 76 pivotally mounted on to the hub may be provided to secure the toroid 26 on to the hub during use.

Although there has been described hereinabove a specific collapsible therapeutic weight system, in accordance with the present invention, for the purpose of illustrating the manner in which the invention may be used to advantage, it will be appreciated that the invention is not limited thereto. Accordingly, any and all modifications, variations, or equivalent arrangements which may occur to those skilled in the art, should be considered to be within the scope of the invention as defined in the appended claims.

What is claimed is:

1. A collapsible weight system comprising:

diaphragm means for containing a liquid, said diaphragm means including accordion-like wall means for enabling said diaphragm means to be collapsed when not containing the liquid;

means defining a sealable opening in said diaphragm means for enabling the filling and emptying of the diaphragm means with the liquid; and means defining an exterior shape of said diaphragm means for enabling said diaphragm means to be disposed in a position wherein the exterior shape of the diaphragm means encircles a patient's limb without bending of said exterior shape.

2. A collapsible weight system comprising:

diaphragm means for containing a liquid, said diaphragm means including accordion-like wall means for enabling said diaphragm means to be collapsed when not containing the liquid;

means defining a sealable opening in said diaphragm means for enabling the filling and emptying of the diaphragm means with the liquid; and means defining a helical exterior shape of said diaphragm means for enabling said diaphragm means to be disposed in a position encircling a patient's limb with the diaphragm means containing liquid and sealed.

3. The collapsible therapeutic weight system according to claim 1 wherein said means defining an exterior shape of said diaphragm means defines a toroid.

4. The collapsible therapeutic weight system according to claim 3 wherein said diaphragm means is collapsible along a longitudinal axis thereof.

5. The collapsible therapeutic weight system according to claim 4 further comprising means for mounting the toroid shaped diaphragm means onto a bar, said bar having a substantially smaller diameter than the opening through the toroid.

6. A collapsible weight system comprising:

diaphragm means for containing various quantities of a liquid, said diaphragm means including foldable wall means for enabling the diaphragm means to expand and contract for accommodating said various quantities of liquid;

means defining a sealable opening in said diaphragm means for enabling the filling and emptying of the diaphragm means with the liquid; and means defining an exterior shape of said diaphragm means for enabling said diaphragm means to be disposed in a position wherein the exterior shape of the diaphragm means encircles a patient's limb without bending of said exterior surface.

7. A collapsible weight system comprising:

diaphragm means for containing various quantities of a liquid, said diaphragm means including foldable wall means for enabling the diaphragm means to expand and contract for accommodating said various quantities of liquid;

means defining a sealable opening in said diaphragm means for enabling the filling and emptying of the diaphragm means with the liquid; and means defining a helical exterior shape of said diaphragm means for enabling said diaphragm means to be disposed in a position encircling a patient's limb with the diaphragm means containing liquid and sealed.

8. The collapsible therapeutic weight system according to claim 6 wherein said means defining an exterior shape of said diaphragm means defines a toroid.

9. The collapsible therapeutic weight system according to claim 8 wherein said diaphragm means is collapsible along a longitudinal axis thereof.

* * * * *